US006207297B1

(12) United States Patent
Sabol et al.

(10) Patent No.: US 6,207,297 B1
(45) Date of Patent: Mar. 27, 2001

(54) BARRIER LAYER FOR A MCRALY BASECOAT SUPERALLOY COMBINATION

(75) Inventors: Stephen M. Sabol, Orlando; John G. Goedjen, Oviedo; Steven J. Vance, Orlando, all of FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/408,322

(22) Filed: Sep. 29, 1999

(51) Int. Cl.[7] ..... B32B 15/00

(52) U.S. Cl. ..... 428/621; 428/632; 428/668; 428/678; 428/679; 428/680

(58) Field of Search ..... 428/610, 615, 428/621, 623, 632, 668, 678, 679, 680; 416/241 R

(56) References Cited

U.S. PATENT DOCUMENTS

| | | | | |
|---|---|---|---|---|
| 3,692,554 | | 9/1972 | Bungardt et al. . | |
| 4,123,594 | * | 10/1978 | Chang | 428/651 |
| 4,321,310 | | 3/1982 | Ulion etg al. . | |
| 4,321,311 | | 3/1982 | Strangman . | |
| 4,486,927 | | 12/1984 | Hunter et al. . | |
| 5,268,238 | | 12/1993 | Czech et al. . | |
| 5,455,119 | * | 10/1995 | Taylor et al. | 428/632 |
| 5,455,199 | | 10/1995 | Sakamoto . | |
| 5,499,905 | | 3/1996 | Schmitz et al. . | |
| 5,556,713 | | 9/1996 | Leverant . | |
| 5,795,659 | | 8/1998 | Meelu et al. . | |
| 5,817,371 | * | 10/1998 | Gupta et al. | 427/454 |

* cited by examiner

*Primary Examiner*—Timothy M. Speer
*Assistant Examiner*—Bryant Young

(57) ABSTRACT

A turbine component contains a substrate (22) such as a superalloy, a basecoat (24) of the type MCrAlY, and a continuous barrier layer (28) between the substrate and basecoat, where the barrier layer (28) is made of an alloy of (Re, Ta, Ru, Os)X, where X can be Ni, Co or their mixture, where the barrier layer is at least 2 micrometers thick and substantially prevents materials from both the basecoat and substrate from migrating through it.

20 Claims, 1 Drawing Sheet

BARRIER LAYER FOR A MCRALY BASECOAT SUPERALLOY COMBINATION

GOVERNMENT CONTRACT

The Government of the United States of America has rights in this invention pursuant to Contract DE-AC05-950R22242, awarded by the United States Department of Energy.

BACKGROUND OF THE INVENTION

1. Field of the Invention

The invention relates to a separate, continuous, dense barrier layer between an MCrAlY basecoat or overlay and a superalloy turbine component, to prevent depletion of Al from the MCrAlY by interdiffusion into the superalloy and to prevent interdiffusion of elements such as Ti, W, Ta and Hf from the superalloy into the coating.

2. Background Information

Numerous overlay and thermal barrier coatings are well know in the gas turbine engine industry as a means of protecting nickel and cobalt based superalloys components, such as blades and vanes, from the harsh oxidation and hot corrosion environments during engine operation. Coatings can be generally classified as overlay and diffusion coatings, providing solely oxidation and corrosion resistance to the superalloy component, and thermal barrier coatings, providing reduced heat transfer between the hot gas path and the cooled turbine component. Generally, thermal barrier coatings are applied over a basecoat of an overlay coating or a diffusion coating.

One type of thermal barrier coating is described in U.S. Pat. Nos. 4,321,310 and 4,321,311. As described therein, a thermal barrier coating is deposited on to a superalloy component (substrate) by first depositing an MCrAlY metal alloy where M is generally nickel, cobalt, or a combination thereof, oxidizing the MCrAlY alloy surface to form an alumina layer in-situ, and depositing a ceramic thermal barrier layer onto the alumina layer.

Other types of thermal barrier coatings utilize ordered intermetallic compounds as the basecoat where aluminum is deposited from the gas phase (U.S. Pat. No. 3,486,927 or liquid phase (U.S. Pat. No. 5,795,659), and heat treated to form a diffusion aluminide intermetallic (typically nickel aluminide, NiAl, cobalt aluminide, CoAl, or mixed (Ni/Co) Al) layer. A modification to the aluminide coating incorporates platinum plating of the substrate prior to gas phase aluminizing to produce a basecoat layer rich in platinum aluminide ($PtAl_2$) (U.S. Pat. No. 3,692,554). Numerous other examples and modifications can be found in the literature and U.S. Patents.

The thermal barrier coating system utilizes a ceramic top coat, such as yttria stabilized zirconia, applied over the basecoat. The ceramic top coat is typically applied by either electron beam physical vapor deposition (EB-PVD) or by plasma spray. The surface of the basecoat is optimized to maximize adherence between the basecoat and the specific ceramic top coat used. For EB-PVD, the basecoat is usually polished and preoxidized prior to deposition of a columnar ceramic thermal barrier layer. In contrast, plasma sprayed top coats favor a rough basecoat surface and do not require the in-situ formation of an aluminum oxide layer prior to deposition. Plasma sprayed ceramic thermal barrier coatings rely on porosity and microcracks to accommodate strain during service.

Regardless of the type of thermal barrier coating system employed, service life is dependent on the formation and maintenance of an aluminum oxide passive layer at the interface between basecoat and the thermal barrier coating. The aluminum oxide layer forms in-situ during fabrication and grows during subsequent service to provide an oxygen barrier preventing further degradation. Similarly, on overlay coatings (with no ceramic layer), oxidation resistance is dependent on the formation and maintenance of an aluminum oxide layer on the surface of the overlay coating.

Aluminum is required to form and is consumed from the basecoat in the formation of the passive aluminum oxide scale. Aluminum is also consumed during interdiffusion of aluminum from the basecoat into the substrate. Failure of the basecoat occurs when there is insufficient aluminum remaining in the basecoat to form and maintain a coherent alumina scale. Furthermore, interdiffusion of certain superalloy constituent elements to the passive aluminum oxide scale can accelerate the degradation process.

Taylor et al (U.S. Pat. No. 5,455,199) examines modifying MCrAlY basecoat alloy chemistry by incorporating heavy metals such as tantalum, rhenium, and/or platinum into the basecoat to slow diffusion and loss of aluminum to the substrate. The reduced diffusivity is also likely to slow the movement of aluminum to the aluminum oxide scale necessary for forming and maintaining the passive scale. Similarly, Czech et al (U.S. Pat. No. 5,268,238) incorporated 1% to 20% rhenium into the basecoat chemistry to slow interdiffusion and increase corrosion resistance. Furthermore, since the heavy metals are present throughout the basecoat alloy, it is expected that the resulting coating will be expensive.

An alternative is to apply a diffusion barrier at the interface between the MCrAlY basecoat and the superalloy. For example, an aluminide or platinum layer is mentioned as a layer in contact with the substrate to provide basecoat durability in U.S. Pat. No. 4,321,311 (Strangman). A plurality of chromium based layers, each resistant to high corrosion temperatures and with diffusion barrier layers of titanium nitride or titanium carbide between layers, is taught as a turbine blade coating in U.S. Pat. No. 5,499,905 (Schmitz et al.).

Leverant teaches in U.S. Pat. No. 5,556,713 that atomic rhenium deposits help slow diffusion of aluminum out of the basecoat layer. A submicron, diffusion deposit of rhenium atoms, formed by vacuum condensing vaporized rhenium onto the superalloy substrate while simultaneously bombarding the substrate surface with an energetic beam of inert ions, such as argon is used to obtain sufficient bonding of the barrier layer to the substrate. The atomic rhenium deposit has a maximum thickness of 1000 nm (1 micrometer), and is preferably 0.05 micron to 0.2 micron thick. This process would seem to be costly and slow, and to only apply primarily to block diffusion of Al out of the basecoat. It would also seem to be limited to simple geometries involving ion beam bombardment, and the ion beam could cause strain on the superalloy structure.

What is needed is a single process to prevent not only diffusion of elements, such as Al, into the superalloy substrate, but also to prevent diffusion of Ti, W, Ta and Hf from the superalloy into the basecoat, thereby causing degrading of the passive aluminum oxide scale on the basecoat by use of a diffusion barrier composition that also allows sufficient coating adhesion. The process should be cost effective and allow coating of large turbine components.

SUMMARY OF THE INVENTION

Therefore, the main object of this invention is to provide an improved diffusion barrier layer preventing Al, W, Ta and Hf migration between the basecoat and the substrate alloy.

It is another object of this invention to provide a barrier layer that also allows sufficient diffusion to provide superior bonding of the diffusion coating substrate, and the basecoat to the diffusion barrier.

These and other objects of the invention are accomplished by providing, a turbine component, containing a substrate, a basecoat of the type MCrAlY, where M is selected from the group comprising of Co, Ni and their mixtures, and a continuous dense, barrier layer between the substrate and basecoat, where the barrier layer comprises an alloy selected from the group consisting essentially of ReX, TaX, RuX, and OsX, where X is selected from the group consisting of Ni, Co and mixtures thereof, and where the barrier layers is at least 2 micrometers thick and effective as a barrier to diffusion of materials through it from both the substrate and the basecoat. The coating thickness can range from 2 micrometers to 25 micrometers (0.001 inches) but cannot be so thick as to prevent adequate bonding of the barrier layer to the substrate, or the basecoat, or result in a non-homogeneous distribution of Re, Ru, Ta, or Os. M preferably consists essentially of CO, Ni and thin mixtures. This barrier layer prevents not only the loss of Al by diffusion into the superalloy substrate, but also, and very importantly, the diffusion of "tramp elements", such as Ti, W, Ta and Hf from the substrate into the basecoat where they can degrade the passive alumina scale, limiting coating life. The barrier layer can be applied to both small and large turbine components of simple or complicated geometry using commercially known techniques, including electroplating and physical vapor deposition.

BRIEF DESCRIPTION OF THE DRAWING

These and other advantages of the invention will be more apparent from the following description in view of the drawings which show.

DETAILED DESCRIPTION OF THE PREFERRED EMBODIMENTS

Figure 1:
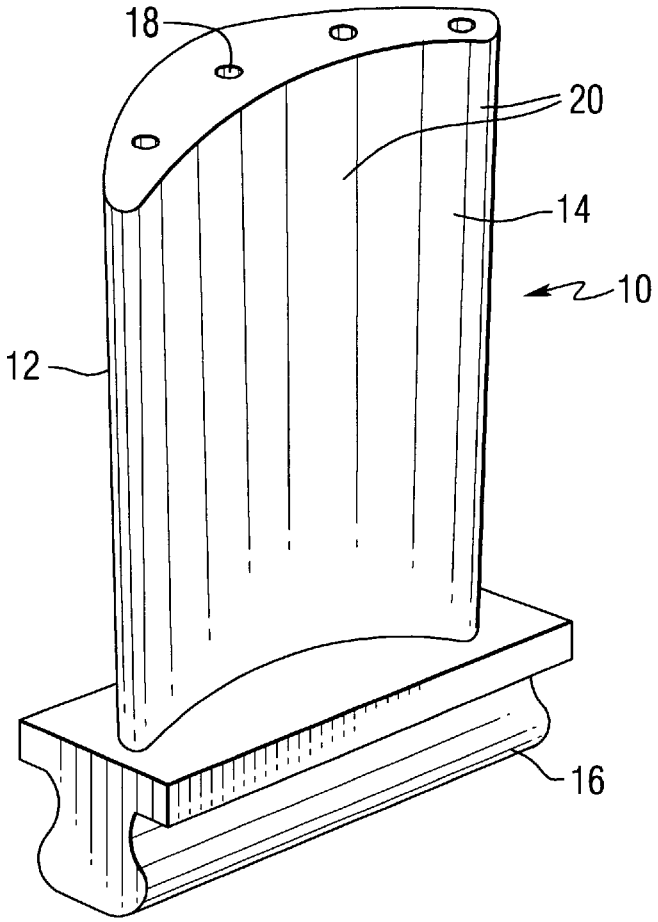
FIG. 1 is a perspective view of a turbine blade coated with protective layers in order to better resist heat, oxidation, and erosion in a thermally stressed operating environment.

Referring now to FIG. 1, one component of a turbine is shown. Turbine blade 10 has a leading edge 12 and an airfoil section 14, against which hot combustion gases are directed during operation of the turbine, and which is subject to severe thermal stresses, oxidation and corrosion. The root end 16 of the blade anchors the blade. Cooling passages 18 may be present through the blade to allow cooling air to transfer heat from the blade. The blade itself can be made from a high temperature resistance nickel or cobalt based superalloy, such as, a combination of Ni.Cr.Al.Co—Ta.Mo.W, or as a more specific example, a composition, by weight, of 10% Co; 8.4% Cr; 0.65% Mo; 10% W; 3.3% Ta, 1.05% Ti; 5.5% Al and 1.4% Hf, with minor amounts of Zr, C, and B, in a Ni matrix (commercially known as "MAR-M247 alloy"). During high temperature use, we have found that minor amounts each of the Ti, W, Ta, and Hf portions are subject to diffusion into the overlying coatings on the edge and airfoil section of the turbine blade. The combination of all four elements amounts to a substantial diffusion effect.

A basecoat 20 would cover the body of the turbine blade, which basecoat could be covered by a thermal barrier coating. The barrier layer of this invention, as well as the basecoat and thermal barrier coating can be used on a wide variety of other components of turbines used with turbine, such as, turbine vanes, blades, or the like, which may be large and of complex geometry, or upon any substrate made of, for example metal or ceramic, where thermal protection is required.

Figure 2:
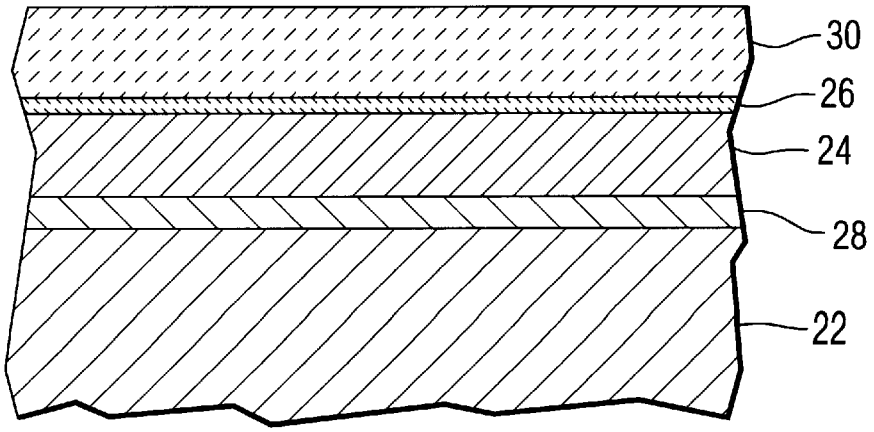
FIG. 2, which best shows the invention, is a fragmented sectional view through a turbine component, such as a turbine blade, showing the barrier layer of this invention between the basecoat and the bottom substrate.

FIG. 2 shows one example of possible thermal barrier coating system for the protection of a turbine component substrate 22 such as the superalloy core of a turbine blade. A basecoat 24 of a MCrAlY-type alloy can be used as a final protection layer or as an intermediate layer, as shown, where M ("metal") in the alloy is usually selected from the group consisting of Ni, Co, Fe and their mixtures and Y is here defined as included yttrium, Y, as well as La, and Hf. This layer can be applied by sputtering, electron beam vapor deposition or one of a number of thermal spray processes including low pressure plasma spraying, high velocity oxygen fuel, and the like to provide a relatively uniform layer about 0.0025 cm to 0.050 cm (0.001 inch to 0.020 inch) thick. This layer can be subsequently polished, to provide a smooth finish. One purpose of this layer is to provide, upon heat treatment, an oxide scale 26, predominately aluminum oxide, about 0.3 micrometers to 5 micrometers thick, in order to further protect the substrate 22 from oxidative attack.

Ordinarily, during high temperature operation of the turbine component, such as a turbine vane at temperatures possibly as high as 1100° C. to 1200° C., substantial migration of Al from the basecoat, as well as migration of at least 1 and usually 2 or more of Ti, W, Ta and Hf from the substrate can occur, as described previously. The migration and subsequent oxidation of Al can cause a thickness increase in the oxide scale 26 causing stress if a final thermal barrier layer 30 is used, and can degrade the protective function of the basecoat itself. The migration of the combination of Ti, W, Ta, and Hf, as well as other elements in the superalloy substrate, can interact with and degrade the oxide scale 26 by diffusion and incorporations of their oxides, particularly $TiO_2$, within the grain boundaries of the aluminum oxide scale severely limiting coating life.

Use of an easily applied fairly thick, discrete, continuous, essentially non-porous layer 28, effective as a barrier to diffusion of materials through it from both the substrate 22 and the basecoat 24, solves a multiplicity of problems within the coating layers applied to the substrate. This layer 28 is composed of an alloy selected from the group consisting of ReX, TaX, RuX, and OsX or (Re, Ta, Ru, Os)X, where X is selected from the group of Ni, Co and mixtures thereof. Preferably the alloy is ReX or TaX, that is, an alloy of Re.Ni, Re.Co, Ta.Ni, Ta.Co or their mixtures. The coating thickness of this barrier layer can range from 2 micrometers to 25 micrometers (0.001 inch) thick, preferably from 2 micrometers to 10 micrometers thick. Over 25 micrometers and adherence of the basecoat to the barrier layer and adherence of the barrier layer to the substrate will suffer. This is because such a large thickness will exaggerate any mismatch in the coefficient of thermal expansion, during service, between the various layers. Under 2 micrometers thickness and Ti, W, Ta, and Hf can easily penetrate to the basecoat from the substrate at temperatures in the order of 1000° C. or higher. Also, under this thickness, long term high temperature exposure may cause the barrier layer to become discontinuous and eventually dissolve or infiltrate into the basecoat, and all protection will be lost. Within the above limits the layer is effective as a barrier, that is, diffusion will be at a rate substantially lower than without the layer so that initially there is about 100% of a barrier, but, over the life of the coating diffusion will slowly start.

Practice of the current invention entails preparation of the substrate surface, deposition of a barrier layer, deposition of an MCrAlY type basecoat and possibly deposition of a ceramic thermal barrier layer. The process may or may not include intermediate heat treatments to aid in bonding of the layers or preparing the surface for subsequent layer deposition, such as in the pre-oxidation of the MCrAlY prior to EB-PVD thermal barrier coating deposition.

Preferably, the substrate is first treated by using a solvent to remove superficial contaminants such as dirt, grease, or imbedded grit followed by deposition of the required barrier film alloy. The barrier film can be deposited by electroplating or physical vapor deposition and should be essentially non-porous, that is over about 90% of theoretical density to about 100% of theoretical density (0% to 10% porous), most preferably if possible 100% dense, in order to be effective in preventing migration of Al, Ti, W, Ta, and Hf. The distribution of Re, Ta, Ru or Os should be uniform and homogeneous throughout the thickness of the barrier coating and the composition of the (Re, Ta, Ru, Os)X alloy should be in the atomic ranges of $(Re, Ta, Ru, OS)_{p=0.3-0.95}\ X_{1-P}$, that is (Re, Ta, Ru, Os) p (where p=about 30–about 95 atom %) X(100 atom % -p).

If p is more than about 95 atom % of the alloy, then, with minimum Ni and/or Co presence at the superalloy interface, there may not be adequate metallurgical bonding between the substrate and the basecoat may not be optimized. If p is less than about 30 atom % of the alloy, then the barrier layer composition begins to resemble the substrate superalloy composition in many aspects, and the barrier layer will allow substantial permeation by Ti, W, Ta and Hf.

The integrity of the oxide scale layer 26 is also very important to adhesion of any exterior thermal barrier top coating 30 that may be used. This thermal barrier can be applied by any method providing good adherence to a thickness effective to provide the required thermal protection for the substrate and basecoat, usually on the order of about 50 micrometers to about 350 micrometers. For example, this ceramic-thermal barrier top coating 30 is advantageously applied by electron beam physical vapor deposition ("EB-PVD"), which usually provides a columnar structure oriented substantially perpendicular to the surface of the substrate. A plasma spray process can also be used. In some instances, it may be useful to apply a second barrier layer, similar to layer 28, between the oxide scale layer 26 and the exterior thermal barrier coating 30.

The invention will now be further clarified by consideration of the following Example.

EXAMPLE

Example 1

Several different diffusion barriers were fabricated utilizing diffusion barrier comprised of rhenium-nickel alloys by EB-PVD depositon of the diffusion barrier. Substrates of IN939 (22% Cr-19% Co-2% W-1% Cb-3.7% Ti-1.9% Al-1.4% Ta-0.15% C) were grit blasted to remove surface contaminants including dirt, grease, surface oxidation or other contaminants.

The grit media was subsequently washed from the surface using an organic solvent (methanol) prior to placing in an EB-PVD coating chamber. The substrate were preheated to 900° C. prior to depositing either a 5 m or 10 m diffusion barrier coating deposition. An alloy of rhenium-nickel was deposited by co-evaporation of pure nickel and pure rhenium from two electron beam heated sources in vacuum. Depending on the electron beam intensity for each pool and the proximity of the substrate to each pool, it was possible to achieve barriers with rhenium contents from 5 to 70 wt % rhenium after the full coating cycle. In the preferred embodiment, the diffusion barrier is 40 to 60%. After applying the diffusion barrier, an MCrAlY basecoat comprised of Co-32Ni-21Cr-8Al-0.5Y was applied using low pressure plasma spray and the system was heat treated at 1080° F. for four hours. A 7% yttria stabilized zirconia thermal barrier top coat was applied using air plasma spray.

Example 2

In another embodiment, the superalloy substrate was degreased using an organic solvent and polished prior to electron beam physical vapor deposition of a 5 m diffusion barrier. Subsequently, an MCrAlY is applied by low pressure plasma spray, diffusion heat treated at 1080° C. for 4 hours, and TBC coated using air plasma spray.

Example 3

In another embodiment, diffusion barriers from alloys comprised of tantalum and nickel were used. Superalloy substrates were grit blasted and washed to remove surface contaminant, preheated to 900° C., and coated with 5 m of a tantalum-nickel diffusion barrier by co-deposition using electron beam physical vapor deposition. The tantalum concentrations can be varied by controlling the heating of the tantalum and nickel sources and by the location of the substrates within the coating chamber. In the preferred embodiment, the diffusion barrier is 60 to 90%. After applying the diffusion barrier, an MCrAlY basecoat was applied using low pressure plasma spray and the system was heat treated at 1080° F. for four hours. A 7% yttria stabilized zirconia thermal barrier top coat was applied using air plasma spray.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting to the scope of the invention which is to be given the full breadth of the claims appended and any and all equivalents thereof.

What is claimed is:

1. A turbine component comprising a substrate, a basecoat of the type MCrAlY, where M is selected from the group consisting of Co, Ni, and their mixtures and a barrier layer between the substrate and basecoat, where the barrier layer comprises an alloy selected from the group consisting of ReX, TaX, RuX, OsX and mixtures thereof, where X is selected from the group consisting of Ni, Co and mixtures thereof, and where the barrier layer is at least 2 micrometers thick and effective as a barrier to inhibit diffusion of materials through it from both the substrate and the basecoat.

2. The turbine component of claim 1, where the substrate is a superalloy.

3. The turbine component of claim 1, where the thickness of the barrier layer is from 2 micrometers to 25 micrometers.

4. The turbine component of claim 1, where the barrier layer inhibits movement of Al diffusing to the substrate from the basecoat and/or at least one of Ti, W, Ta and Hf diffusing to the basecoat from the substrate.

5. The turbine component of claim 1, where the thickness of the barrier layer is from 2 micrometers to 10 micrometers and the barrier layer has a density of over about 90% of theoretical density.

6. The turbine component of claim 1, where in the barrier alloy Re, Ta, Ru, and/or Os is present in an amount of about 30 to about 95 atom %.

7. The turbine component of claim 1, where the basecoat has an oxide scale layer and the barrier layer is a barrier to at least one of Ti, W, Ta, and Hf diffusing through the basecoat from the substrate to interact with the oxide scale layer.

8. The turbine component of claim 1, where the basecoat has a top coat of an oxide scale layer and an exterior thermal barrier layer contacting the oxide scale layer.

9. A turbine component comprising a substrate, a basecoat of the type MCrAlY, where M is selected from the group consisting of Co, Ni and their mixtures and a continuous dense, barrier layer between the substrate and basecoat, where the barrier layer comprises an alloy selected from the group consisting of ReX, TaX, RuX, and OsX, where X is selected from the group consisting of Ni, Co and mixtures thereof, and where the barrier layer has a density over about 95% of theoretical density, a thickness of from 2 micrometer to 10 micrometers and is an effective barrier to Al diffusing to the substrate from the basecoat and at least one of Ti, W, Ta and Hf diffusing to the basecoat from the substrate.

10. A turbine component comprising a substrate and an MCrAlY type basecoat, where directly over the substrate there is a deposition of a diffusion barrier alloy where there is about 30 to 95 atom % Re, Ta, Ru, or Os present in the alloy.

11. The turbine component of claim 1, where the turbine component is a turbine blade.

12. The turbine component of claim 11, where the turbine blade has a leading edge and an airfoil section against which hot combustion gases are directed.

13. The turbine component of claim 1, where the turbine component operates in an environment having a temperature as high as 1200° C.

14. The turbine component of claim 1, where the barrier layer is applied by a deposition technique consisting of electroplating and physical vapor deposition.

15. The turbine component of claim 1, where the barrier layer is applied as a continuous layer on the turbine component.

16. The turbine component of claim 1, where the barrier layer is non-porous to essentially prevent diffusion of materials through it from both the substrate and the basecoat.

17. The turbine component of claim 1, where the barrier layer has a sufficient thickness so as to suitably adhere to the basecoat and to the substrate, but not to unsuitably exaggerate any mismatch in the coefficient of thermal expansion between the basecoat and the substrate.

18. The turbine component of claim 1, where the barrier layer is a non-ceramic material that tends to prevent spallation of the MCrAlY type basecoat.

19. The turbine component of claim 1, where the substrate is made of a metal or ceramic material.

20. The turbine component of claim 1, where the substrate is first treated with a solvent to remove superficial contaminants on the substrate before the barrier layer is deposited on the substrate.

* * * * *